US007000552B2

(12) United States Patent
Kim

(10) Patent No.: US 7,000,552 B2
(45) Date of Patent: Feb. 21, 2006

(54) INTERLINING FOR SUIT AND METHOD FOR MAKING THE SUIT BY USING THE SAME

(76) Inventor: Soon-Sun Kim, 306-904 Jukong 3th Apt., 606-1 Duksori, Wabueub, Namyangju, Kyonggi-do 472-900 (KR)

( * ) Notice: Subject to any disclaimer, the term of this patent is extended or adjusted under 35 U.S.C. 154(b) by 129 days.

(21) Appl. No.: 10/451,974

(22) PCT Filed: Jan. 24, 2002

(86) PCT No.: PCT/KR02/00108

§ 371 (c)(1),
(2), (4) Date: Jun. 30, 2003

(87) PCT Pub. No.: WO02/060289

PCT Pub. Date: Aug. 8, 2002

(65) Prior Publication Data

US 2004/0049833 A1 Mar. 18, 2004

(30) Foreign Application Priority Data

Feb. 1, 2001 (KR) ..... 2001-4787

(51) Int. Cl.
*D05B 35/06* (2006.01)

(52) U.S. Cl. ..... 112/475.09; 112/418

(58) Field of Classification Search ..... 112/475.09, 112/152, 405, 417, 418, 441; 2/272, 274, 2/275, 93, 97; 156/91–93
See application file for complete search history.

(56) References Cited

U.S. PATENT DOCUMENTS

| | | | | |
|---|---|---|---|---|
| 762,359 | A * | 6/1904 | Steinberg | 2/255 |
| 1,106,199 | A * | 8/1914 | Pink | 2/255 |
| 1,683,226 | A * | 9/1928 | Zuck | 2/272 |
| 1,784,942 | A * | 12/1930 | Miller | 112/418 |
| 2,275,090 | A * | 3/1942 | Reiss et al. | 2/97 |
| 4,521,921 | A * | 6/1985 | Bregatta | 2/93 |
| 4,796,305 | A * | 1/1989 | Itoh | 2/97 |
| 5,669,072 | A * | 9/1997 | Bjorklund | 2/93 |

FOREIGN PATENT DOCUMENTS

| | | |
|---|---|---|
| JP | 6-22320 U | 3/1994 |
| JP | 6-59421 U | 8/1994 |
| KR | 83-5667 A | 9/1983 |

* cited by examiner

*Primary Examiner*—Ismael Izaguirre
(74) *Attorney, Agent, or Firm*—Park Law Firm; John K. Park

(57) ABSTRACT

Disclosed is an interlining for a suit that is attached between outer cloth and inner cloth and a method for making a suit by using the same. The interlining for the suit according to the present invention includes an upper interlining being of a vertical texture, a lower interlining being of a diagonal texture, and a piece of connecting cloth for connecting the upper interlining and the lower interlining, whereby the interlining for the suit exhibits an excellent restoring force, even when it is wet in the rain or washed.

3 Claims, 5 Drawing Sheets

INTERLINING FOR SUIT AND METHOD FOR MAKING THE SUIT BY USING THE SAME

TECHNICAL FIELD

The present invention relates to an interlining for a suit that is attached between outer cloth and inner cloth of the suit and a method for making a suit by using the same.

BACKGROUND ART

As some examples of prior art, there have been provided Korean Utility Model Application No. 1979-0002564 (entitled by 'The Interlining for an Upper Suit') in which the width of the shoulder of the suit can be adjusted, Korean Patent Application No. 1981-0003148 (entitled by 'non-woven fabrics interlining') where a thermal adhesive is partially applied, and Korean Patent Application No. 1994-032790 (entitled by 'Interlining for Suit and Method for Making the Same') in which the curved side of the interlining is molded after heated and pressurized in order to make it smooth.

Referring to a conventionally developed interlining for a suit as shown in FIG. 1, the interlining 11 is cut out in a predetermined pattern and cut open at one upper peripheral portion thereof and one intermediate peripheral portion thereof, respectively. In this case, the one upper peripheral portion of the interlining 11 is opened and sewed with a piece of auxiliary cloth 19 on the back side thereof, and the one intermediate peripheral portion 10 thereof is somewhat folded and sewed with each other. Then, several pieces of additional cloth 18 are sewed to each other and thus attached on the interlining 11.

In the conventional interlining for the suit, however, since the interlining 11 is cut in a vertical texture way 16 and made as a unitary body, there are some disadvantages that when the suit is wet in the rain or washed, the interlining 11 is not fully restored due to the difference of the tension between the outer cloth thereof and the interlining, such that it may be well wrinkled or stiffened.

Moreover, a conventional process of attaching the interlining for the suit on the outer cloth includes the steps of; a) cutting the upper portion of the interlining and the intermediate portion thereof and sewing them in respective ways; b) making an unfinished interlining; c) laying the unfinished interlining on the outer cloth of the suit; d) making a thread mark on the unfinished interlining; e) making tacking on the collar of the suit; f) drawing the portion to be cut out; g) cutting the spare portion of the interlining; and h) attaching tape on the interlining, as shown in FIG. 4. Of course, this causes some defects that its process is made in complicated ways, the work is carried out in a manually operated manner, and much time and cost are consumed.

Furthermore, since the unfinished interlining is made in a size enough and the other portion thereof except the portion to be really used as the interlining is all removed, the piece of cloth for the interlining may be unnecessarily consumed.

DISCLOSURE OF INVENTION

An interlining for a suit and a method for making a suit by using the same according to the present invention are applicable to all suits, such as male suits, female suits, coats, etc. in which the interlining is used.

The construction of the interlining for the suit will be explained with reference to FIG. 2.

The interlining of the present invention includes an upper interlining 21 being of a vertical texture 26, a lower interling 23 being of a diagonal texture 27, and a piece of connecting cloth 22 for connecting the upper interlining 21 and the lower interlining 23.

The portion that is opened in the upper periphery of the upper interlining 21 is sewed with a piece of auxiliary cloth 29, and the portion 20 that is opened in the intermediate periphery of the upper interlining 21 is somewhat folded and sewed to each other. Next, two to four pieces of attaching cloth 28 are fixed on the upper interlining 21. And, first adhesive tape 24 is applied on the back surface of the collar portion of the upper interlining 21, and second adhesive tape 25 is applied on the portion to be attached to the outer cloth of the suit ranged from the bottom of the collar to the end of the lower interlining 23.

The interlining for the suit is comprised of the upper interlining 21 and the lower interlining 23 and the lower interlining 23 is of the diagonal texture 27, such that the interlining can be expanded and contracted according to the flexibility of the outer cloth of the suit. Therefore, when compared with the conventional unitary type interlining, the interlining according to the present invention exhibits more excellent restoring force, such that even though it is wet in the rain or washed, it is not well wrinkled and kept smooth.

In addition, when the unfinished interlining for the suit as used conventionally is attached on the outer cloth of the suit it should be disposed on the outer cloth of the suit and cut out according to its size, through a number of manually operating processes in complicated ways. With the interlining of the present invention, contrarily, a method for making the suit provides the following advantages: first, the piece of cloth to be used as the interlining can be saved in size; the process is carried out in simple and automated manners; and the manufacturing cost and time are all decreased.

BRIEF DESCRIPTION OF THE DRAWINGS

Further objects and advantages of the invention can be more fully understood from the following detailed description taken in conjunction with the accompanying drawings, in which.

BEST MODE FOR CARRYING OUT THE INVENTION

Figure 1:
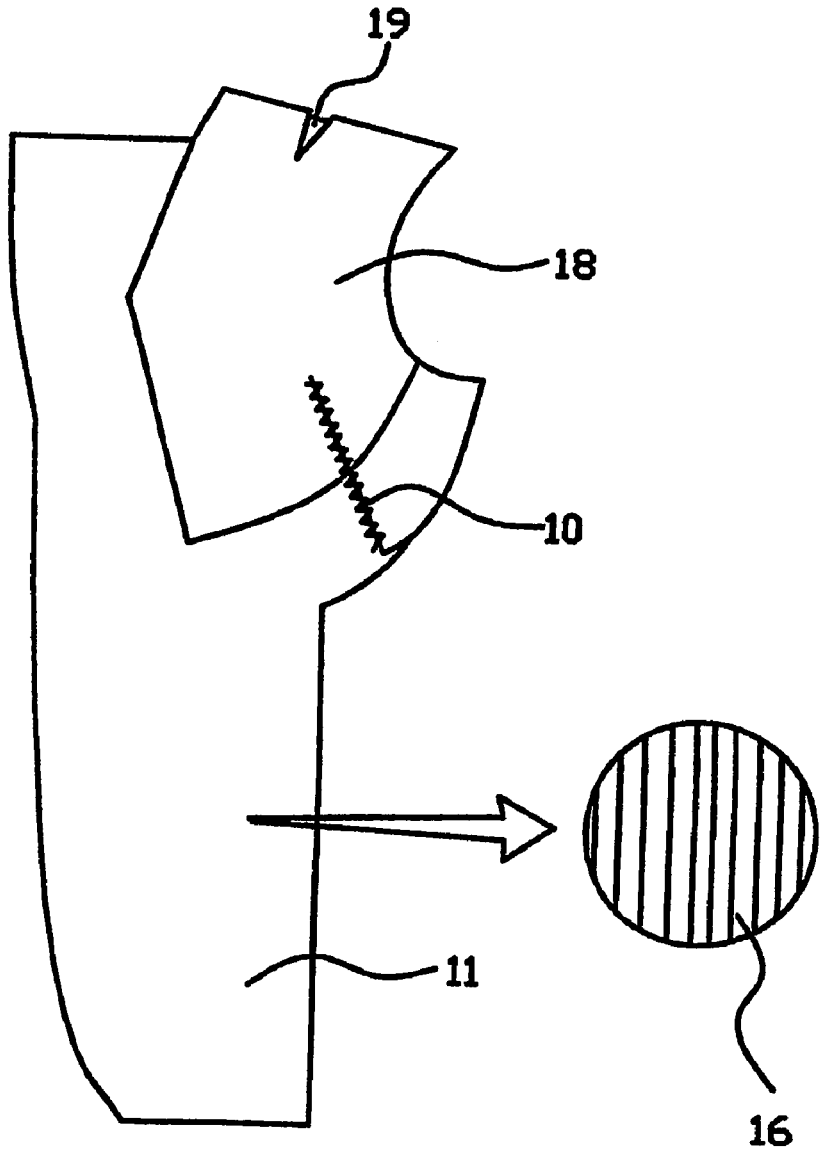
FIG. 1 (PRIOR ART)
FIG. 1 shows a conventional interlining for a suit.
Figure 2:
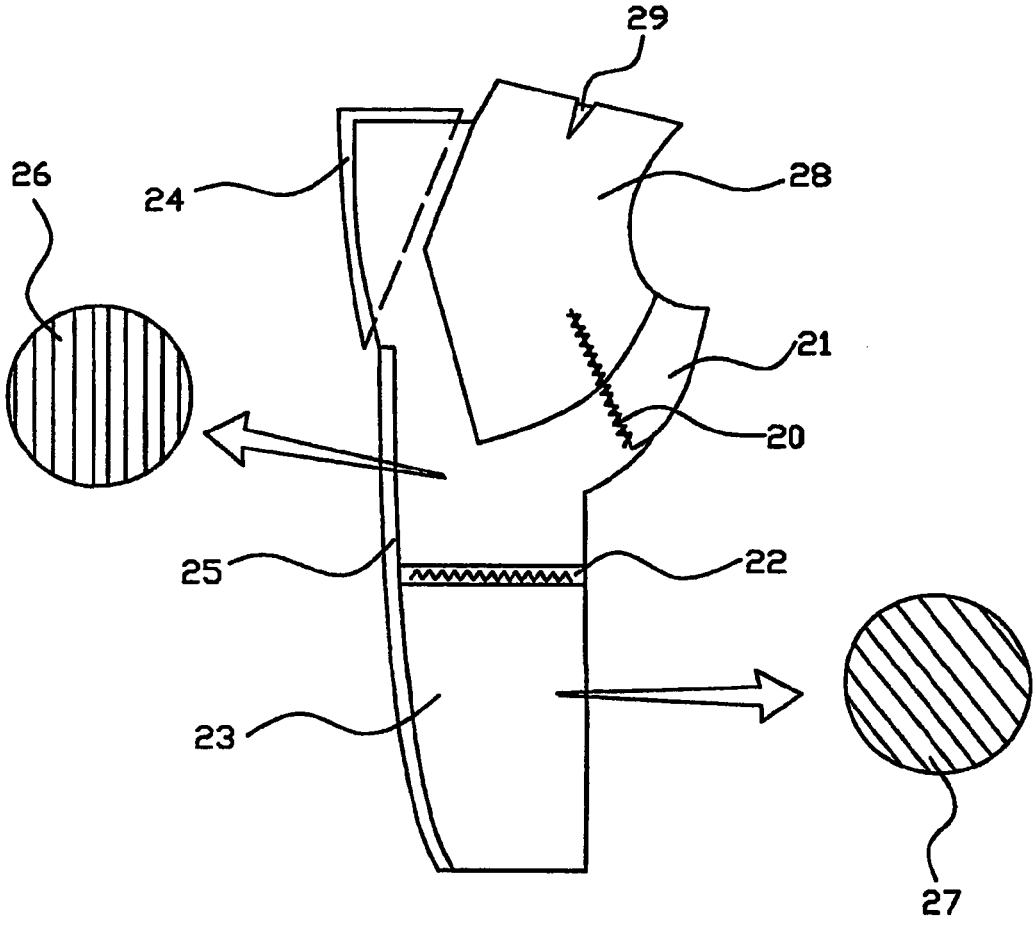
FIG. 2 shows an interlining for a suit according to an embodiment of the present invention.
Figure 5:
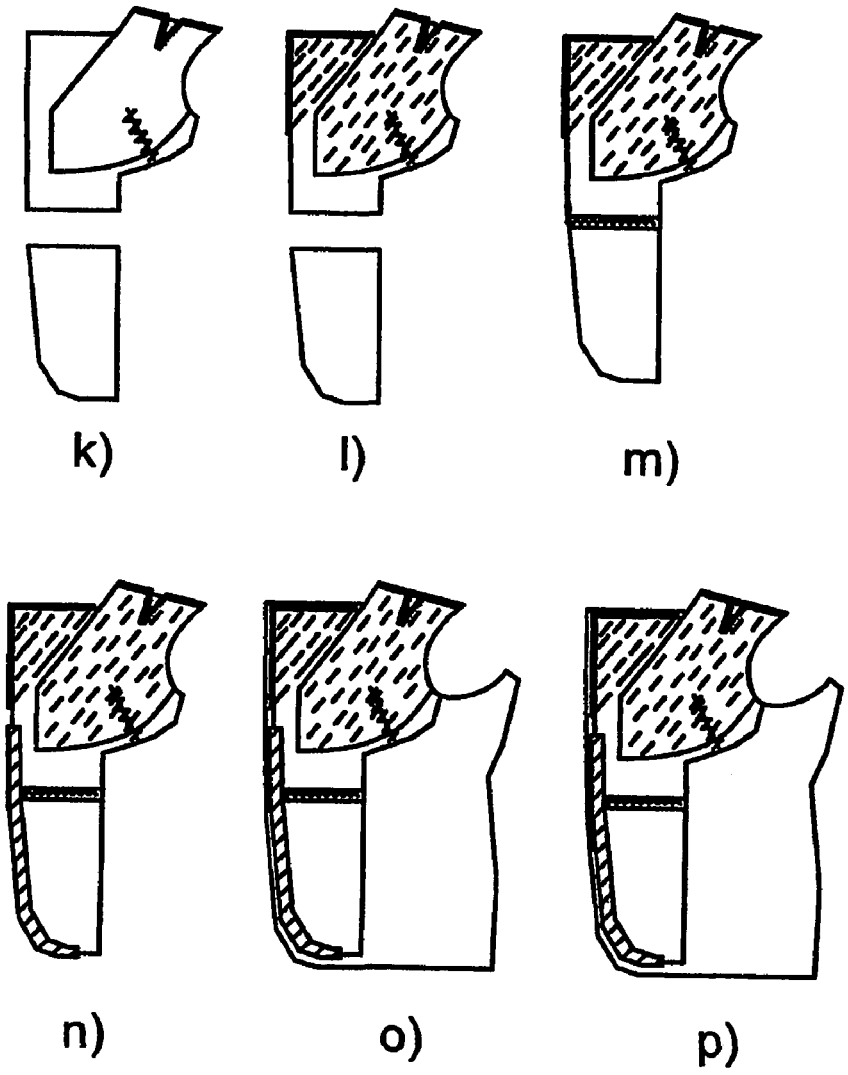
FIG. 5 shows a procedure for attaching the interlining of the present invention on the suit.

Hereinafter, an explanation of an interlining for a suit and a method for making a suit by using the same according to the preferred embodiments of the present invention will be described with reference to FIGS. 2 and 5.

An upper interlining 21 and a lower interlining 23 as an interlining of the present invention are cut out in accordance with the size of the suit to be made. In that case, the upper interlining 21 is made in the vertical texture 26 in the same manner as the conventional one, and the lower interlining 23 is made in the diagonal texture 27.

Using a conventional way, one upper periphery portion of the upper interlining 21 and one intermediate periphery portion thereof are cut out. Thus, the upper periphery portion of the upper interlining 21 is sewed with the piece of auxiliary cloth 29, and the intermediate-periphery portion 20 thereof is somewhat folded and sewed to each other. Next, the two to four pieces of attaching cloth 28 are fixed on the upper interlining 21. And, the first adhesive tape 24 is applied on the back surface of the collar of the upper interlining 21.

The upper interlining 21 and the lower interlining 23 are sewed by using the piece of connecting cloth 22 and thus connected to each other.

And, the second adhesive tape 25 is applied on the portion to be attached to the outer cloth of the suit ranged from the bottom of the collar to the end of the lower interlining 23.

The interlining of the present invention is laid on the outer cloth of the suit and heated and pressed, such that it can be completely attached thereon.

Figure 3:
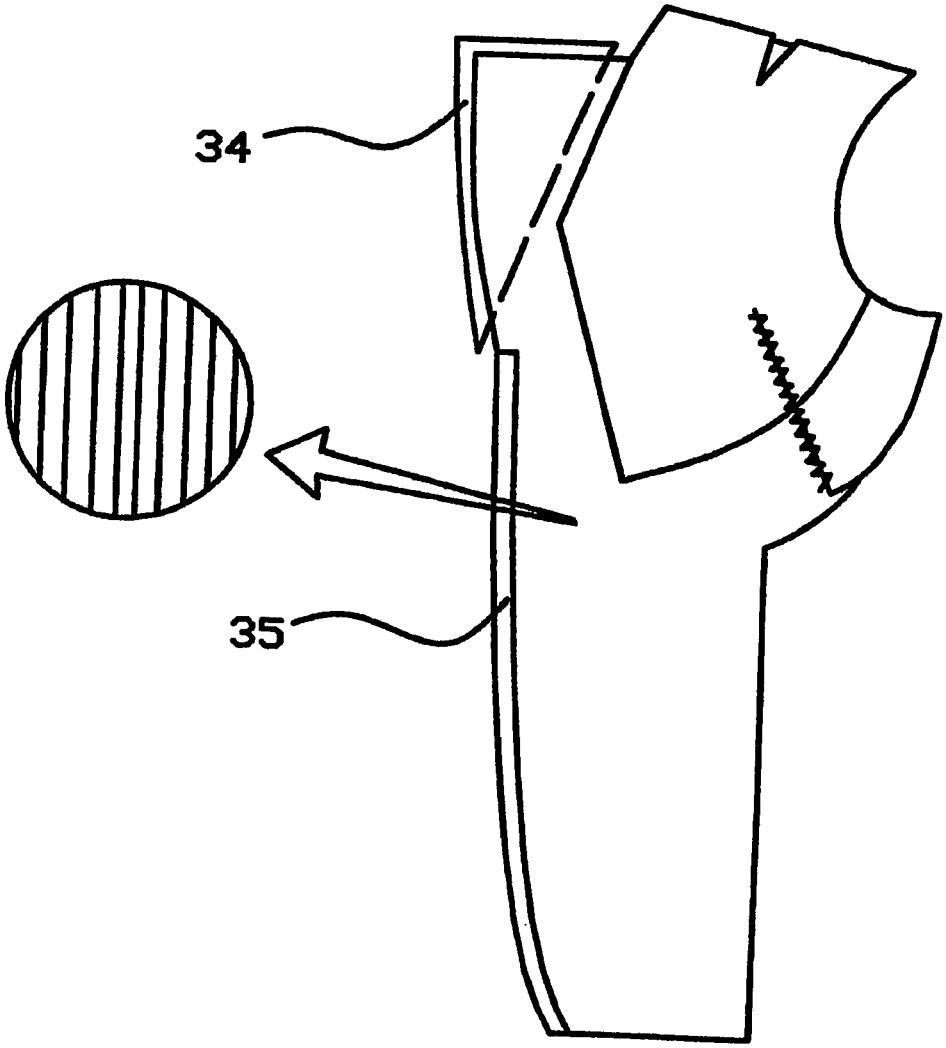
FIG. 3 shows an interlining for a suit according to another embodiment of the present invention.
Figure 4:
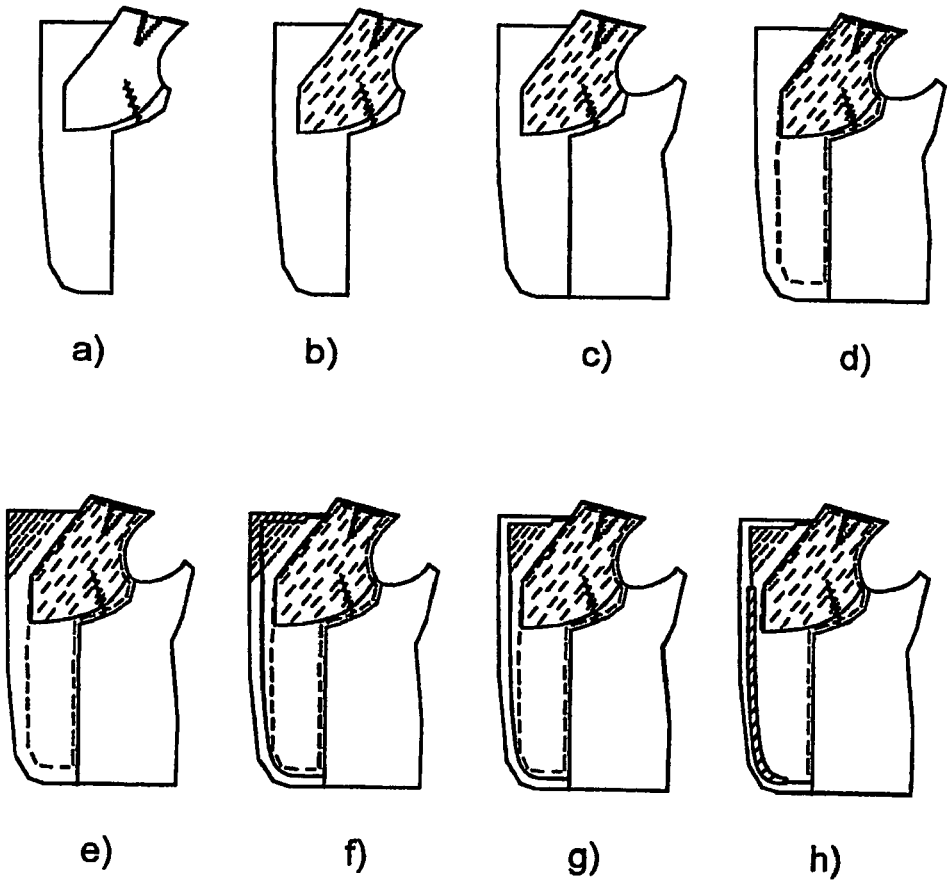
FIG. 4 shows a procedure for attaching the conventional interlining on the suit.

According to another embodiment of the present invention, as shown in FIG. 3, the interlining for the suit is made as a unitary body, with no upper and lower interlinings. In this case, the interlining is cut out in accordance with the size of the suit to be made and first and second adhesive tape 34, 35 are previously applied on their appropriate positions before the interlining is laid on the outer cloth of the suit.

On the other hand, the first and second adhesive tape may be used with an adhesive sheet, both-side tape, an adhesive or other substances having an adhesive strength.

INDUSTRIAL APPLICABILITY

As set forth in the foregoing, there is provided an interlining for a suit according to the present invention that exhibits an excellent restoring force, even when it is wet in the rain or washed.

Furthermore, a method for making a suit by using an interlining according to the present invention has the following advantages: first, the piece of cloth to be used as the interlining can be saved in size; the process is carried out in simple and automated manners; and the manufacturing cost and time are all decreased.

While the present invention has been described with reference to a specific embodiment, the description is illustrative of the invention and is not to be construed as limiting the invention. Various modifications may occur to those skilled in the art without departing from the true spirit and scope of the invention as defined by the appended claims.

What is claimed is:

1. An interlining for a suit that is attached between outer cloth and inner cloth, being characterized in that it comprises an upper interlining(21) being of a vertical texture(26), a lower interlining(23) being of a diagonal texture(27), a piece of connecting cloth(22) for connecting said upper interlining (21) and said lower interlining(23), a first adhesive tape(24) that is applied on the back surface of the collar of said upper interlining(21) and a second adhesive tape(25) that is applied on the portion to be attached to an outer cloth of the suit ranged from the bottom of the collar to the end of said lower interlining(23).

2. An interlining for a suit that is attached between outer cloth and inner cloth, being characterized in that it is made as a unitary body and has a first adhesive tape(34) that is applied on the collar portion of the back surface thereof and a second adhesive tape(35) that is applied on the portion to be attached to an outer cloth of the suit ranged from the bottom of the collar to the end thereof.

3. A method for making a suit by using an interlining, that is comprised of an upper interlining(21) being of a vertical texture(26), a lower interlining(23) being of a diagonal texture(27), and a piece of connecting cloth(22) for connecting said upper interlining and said lower interlining, said method comprising the steps of: k) cutting the upper portion of said upper interlining and the intermediate portion thereof and sewing them in respective ways; l) doing said upper interlining into a quilt; m) sewing said upper interlining and said lower interlining; n) attaching tape on said upper interlining and said lower interlining; o) laying said upper interlining arid said lower interlining on the outer cloth of the suit; and p) heating and pressurizing said upper interlining and said lower interlining and attaching them on the suit.

* * * * *